United States Patent [19]

Kusumoto

[11] Patent Number: 5,031,001

[45] Date of Patent: Jul. 9, 1991

[54] TONER COLLECTING DEVICE FOR ELECTROPHOTOGRAPHIC EQUIPMENT WHICH REDUCES A LOAD ACTING ON A COLLECTING ROLLER

[75] Inventor: Hiroshi Kusumoto, Tokyo, Japan

[73] Assignee: Ricoh Company, Ltd., Tokyo, Japan

[21] Appl. No.: 377,948

[22] Filed: Jul. 11, 1989

[30] Foreign Application Priority Data

Jul. 20, 1988 [JP] Japan ..... 63-95976[U]

[51] Int. Cl.[5] ..... G03G 21/00

[52] U.S. Cl. ..... 355/298; 15/256.51; 118/652

[58] Field of Search ..... 355/296, 297, 298, 299, 355/301, 215, 269, 302, 260; 118/652; 222/DIG. 1; 15/256.51, 256.52, 256.5, 256.53, 1.5 R

[56] References Cited

U.S. PATENT DOCUMENTS

| | | | |
|---|---|---|---|
| 3,838,472 | 10/1974 | Oriel | 15/256.51 |
| 4,140,389 | 2/1979 | Franke et al. | 355/298 X |
| 4,251,155 | 2/1981 | Schnall et al. | 355/298 |
| 4,451,139 | 5/1984 | Yanagawa et al. | 355/297 |
| 4,711,561 | 12/1987 | Tsuruoka | 355/298 |
| 4,730,205 | 3/1988 | Ogiri et al. | 355/298 |
| 4,768,062 | 8/1988 | Tanzawa et al. | 355/298 |

FOREIGN PATENT DOCUMENTS

| | | | |
|---|---|---|---|
| 3743587 | 6/1988 | Fed. Rep. of Germany | 355/298 |
| 0202462 | 10/1985 | Japan | 355/298 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A device for use in electrophotographic equipment for collecting toner particles which are removed from a photoconductive element, or image carrier, after image-wise transfer. A collecting roller is located in a portion of a toner tank remote from the bottom of the tank, while a partition formed with a plurality of holes is situated below and in close proximity to the collecting roller. The partition and the bottom of the toner tank define therebetween a space for accommodating the toner being collected. The toner removed from the photoconductive element drops onto the partition. In a first stage, the toner drops through the holdes of the partition to accumulate in the space between the partition and the bottom of the toner tank. In a second stage wherein the toner accumulates to a level above the partition, the toner on the partition is forced out by the collecting blade which is caused into an oscillatory motion by the collecting roller and is thereby dropped over the front end of the partition to accumulate in the toner tank at the front of the partition. In a third stage wherein the toner reachs the collecting blade, the weight of the toner acts on the blade for the first time, and the toner fills up the space remaining in the upper portion of the toner tank.

7 Claims, 6 Drawing Sheets

TONER COLLECTING DEVICE FOR ELECTROPHOTOGRAPHIC EQUIPMENT WHICH REDUCES A LOAD ACTING ON A COLLECTING ROLLER

BACKGROUND OF THE INVENTION

The present invention relates to an electrophotographic copier, facsimile machine, laser printer or similar equipment which uses an electrophotographic procedure. More particularly, the present invention is concerned with a device installed in such equipment for collecting toner particles which remain on a photoconductive element, or image carrier, after imagewise transfer.

In equipment of the type described, an electrostatic latent image representative of an original image to be recorded is formed on a photoconductive element. The latent image is developed by a toner which is fed from a developing unit to become a toner image. After the toner image has been transferred from the photoconductive element to a paper sheet, the toner remaining on the photoconductive element is removed by a fur brush and a cleaning blade which are held in contact with the photoconductive element. The removed toner is collected in a toner tank. It has been customary to collect the toner in the toner tank through an opening which is formed through a bottom portion of the tank. A collecting roller having a polygonal cross-section and a collecting blade are disposed in the opening in contact with each other. As the collecting roller is driven in a rotary motion in a predetermined direction, it urges the free end or tip of the collecting blade with the apexes of the polygonal cross-section to thereby cause the blade into a periodical oscillatory motion. The collecting blade being so moved forces the toner into the toner tank. When the toner being collected fills up the toner tank, a sensor mounted on the top of the toner tank is actuated by the toner to show that the tank is full. In this kind of prior art toner collecting arrangement, since the opening for collecting the toner is located in close proximity to the bottom of the toner tank and since the collecting roller and collecting blade are disposed in this opening, the load acting on the blade, i.e., on the roller increases with the amount of toner in the tank. Therefore, it is necessary to sequentially increase the output force of a drive source which drives the collecting roller. When the load acting on the roller sequentially increases from the start of a collecting operation until the toner tank becomes full as stated above, it effects the driving system and thereby renders the control thereover difficult. The influence of the varying load on the driving system appears as jitters in a resulting image to lower the image quality to a noticeable extent.

SUMMARY OF THE INVENTION

It is therefore an object of the present invention to provide a toner collecting device for electrostatic equipment which insures high image quality.

It is another object of the present invention to provide a toner collecting device for electrostatic equipment which promotes efficient use of a toner tank.

It is yet another object of the present invention to provide a toner collecting device for electrophotographic equipment which substantially eliminates the variation in the load acting on a collecting roller and which is ascribable to the increase in the amount of toner being collected in a toner tank.

It is a further object of the present invention to provide a generally improved toner collecting device for electrophotographic equipment.

A device for use in an electrophotographic apparatus for collecting a toner which remains on a photoconductive element after imagewise transfer of the present invention comprises a toner tank having an opening formed in an upper portion thereof for collecting the toner which is removed from the photoconductive element, toner feeding members located below and in close proximity to the opening of the toner tank for feeding into the toner tank the removed toner which is introduced in the opening, and a partition disposed below and in close proximity to the toner feeding members. The toner tank has a bottom which cooperates with the partition to define a space for accommodating a major part of the collected toner.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
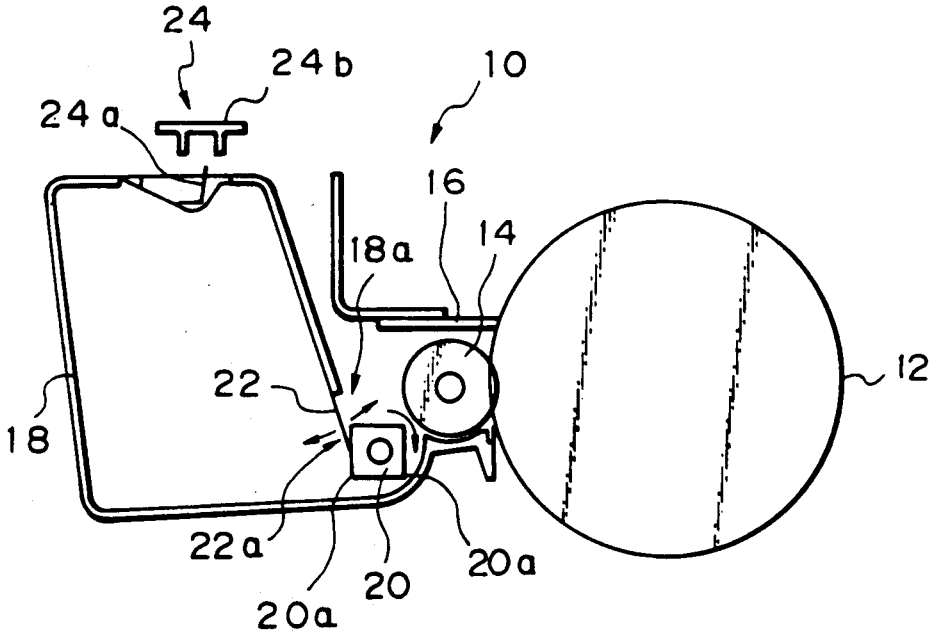
Fig. 1 PRIOR ART
FIG. 1 is a sectional view showing a prior art toner collecting device.

To better understand the present invention, a brief reference will be made to a prior art toner collecting device which is installed in a laser printer, shown in FIG. 1. The prior art toner collecting device, generally 10, includes a fur brush 14 and a cleaning blade 16 which are held in contact with a photoconductive drum 12. Toner particles remaining on the drum 12 after imagewise transfer are removed by the fur brush 14 and cleaning blade 16 and dropped into an opening **18*a* which is formed through a lower portion of a toner tank 18**.

A collecting roller 20 having a polygonal cross-section is disposed in the opening **18*a* of the toner tank 18. Also disposed in the opening 18*a* is a collecting blade 22 which is held in contact with the collecting roller 20 and implemented by a polyester film or similar flexible material. While the roller 20 is rotated clockwise as indicated by an arrow in the figure, it repetitively uges the tip or free end 22*a* of the blade 22 with the apexes 20*a* of the polygonal cross-section. As a result, the blade 22** is moved in a periodical oscillatory motion as indicated by arrows in the figure, forcing out the toner particles into the toner tank 18. A sensor 24 is mounted on the top of the toner tank 18 and constituted by a feeler 24*a* and a photointerrupter 24*b*. When the toner having been collected in the toner tank 18 fills up the tank 18, it forces the feeler 24*a* upward to block the optical path of the photointerrupter 24*b*. The resulting output of the photointerrupter 24*b* shows that the tank 18 has been filled up with the collected toner.

Basically, the toner collecting implementation described above has a drawback that the load acting on the collecting roller 20 varies every time each apex 20*a* of the roller 20 reaches and moves away from the collecting blade 22. The variation in the load becomes greater as the amount of toner collected in the toner tank 18 increases. More specifically, as the toner is collected in the toner tank 18, its weight acts on the blade 22 and, therefore, the roller 20 has to urge the blade 22 by overcoming such a weight. Since the roller 20 and blade 22 are located in close proximity to the bottom of the toner tank 18, a load begins to act on the blade 20 as soon as the toner begins to accumulate on the bottom of the tank 18. As the load acting on the blade 20 sequentially increases with the amount of toner being collected in the toner tank 18, the variation in the load acting on the roller 20 is further aggravated to effect a driving system associated with the roller 20, resulting in jitters which degrade the image critically, as discussed earlier.

Figure 2:
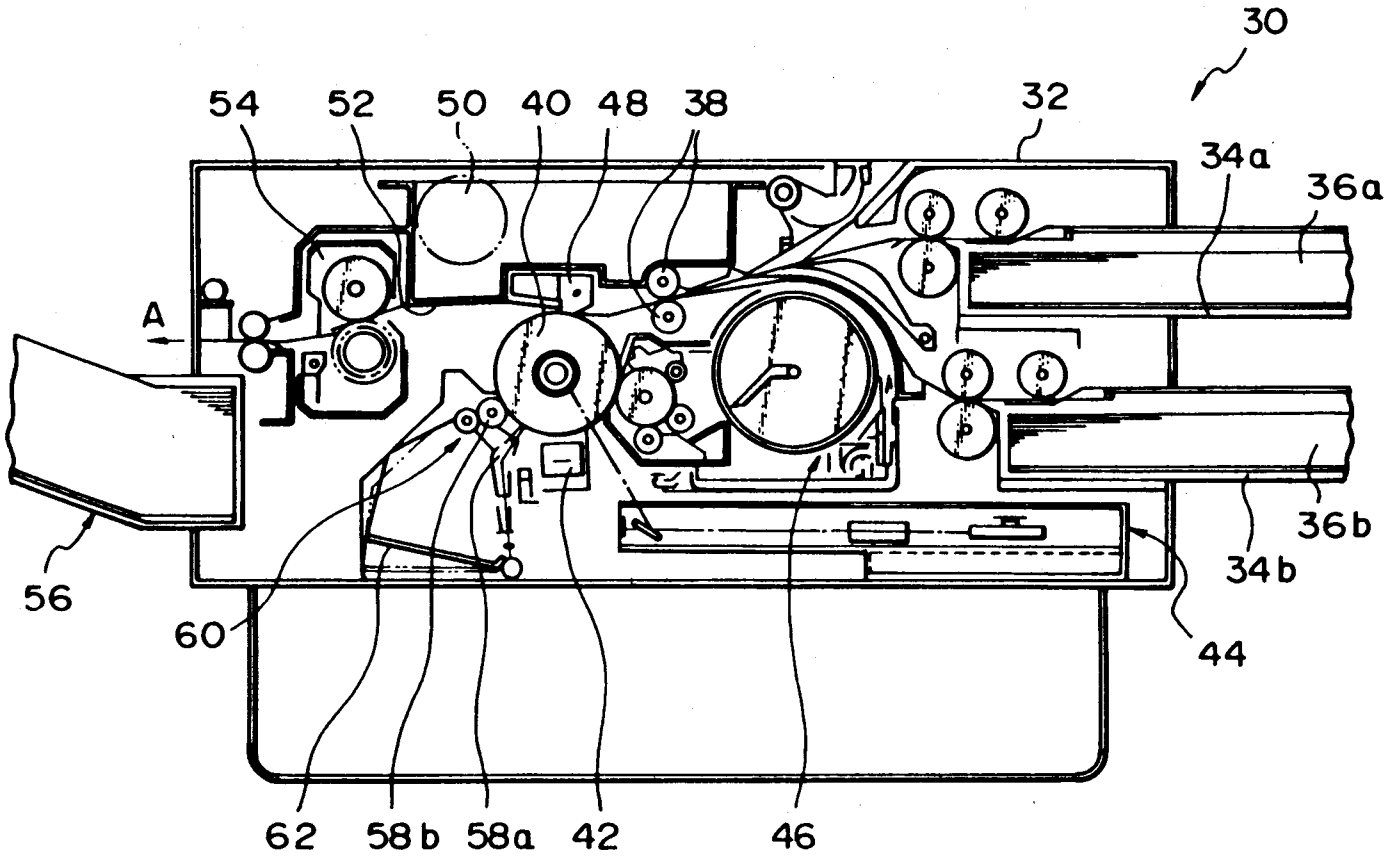
FIG. 2 is a sectional view showing a specific construction of a laser printer in which a toner collecting device embodying the present invention is incorporated.

Referring to FIG. 2, a laser printer belonging to a family of electrophotographic equipment is shown which incorporates a toner collecting device embodying the present invention. As shown, the laser printer, generally 30, has a printer body 32 which is loaded with a pair of paper cassettes 34*a* and 34*b*. A paper sheet 36*a* or 36*b* fed from the paper cassette 34*a* or 34*b* is driven by a register roller pair 38 toward an upper portion of a photoconductive drum 40 at a predetermined timing. While the drum 40 is rotated counterclockwise as viewed in FIG. 2, its surface is charged to a predetermined polarity by a main charger 42. As the charged surface of the drum 40 is illuminated by a laser beam which issues from laser optics, a latent image is electrostatically formed on the drum 40. As the latent image reaches a developing unit 46, it is developed by a toner which is fed from the developing unit 46. The resulting toner image is transferred by a transfer charger 48 to the lower surface of the paper sheet 36*a* or 36*b* which has been transported to the drum 40. The paper sheet 36*a* or 36*b* carrying the toner image thereon is guided by a guide 52 toward a fixing unit 54 while being sucked onto the guide 52 by a suction fan 50. Then, the paper sheet 36*a* or 36*b* having the toner image fixed by the fixing unit 54 is driven out of the printer body 32 to a discharge section 56, as indicated by an arrow A. After the imagewise transfer, toner particles remaining on the drum 40 are removed by a cleaning blade 58*a* and a fur brush 58*b* which is located above the cleaning blade 58*a*. A toner collecting device 60 embodying the present invention collects the removed toner in a toner tank 62.

Figure 3:
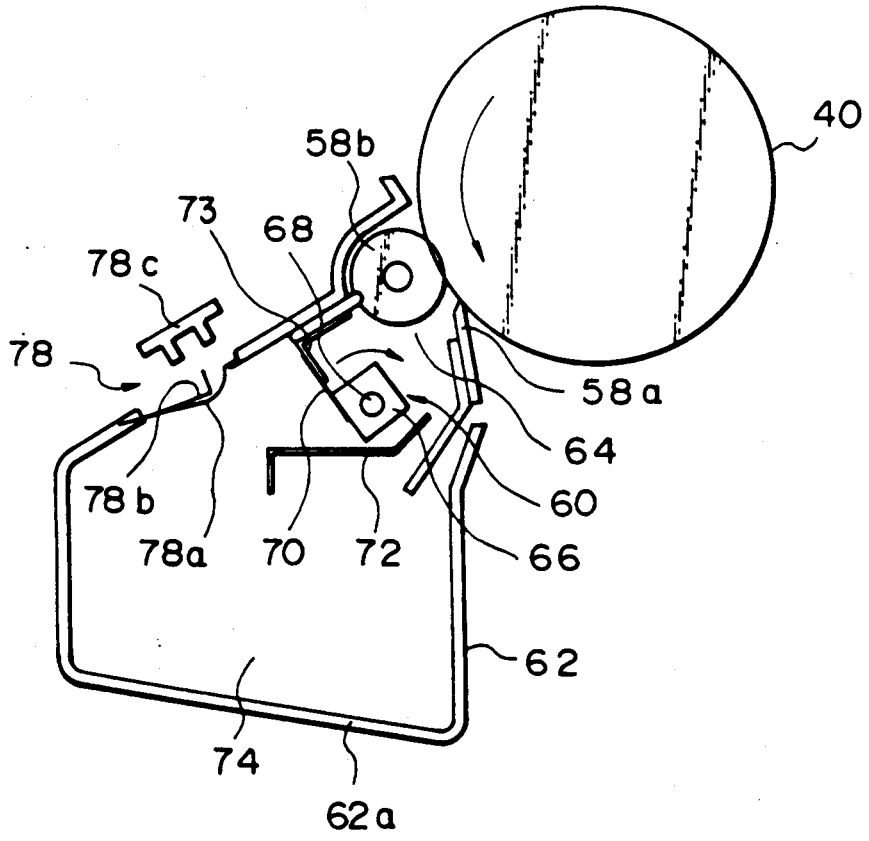
FIG. 3 is a sectional view of the toner collecting device embodying the present invention in detail.

FIG. 3 indicates the toner collecting device 60 in detail. An opening 64 is formed in an upper end portion of the toner tank 62 to face the drum 40 obliquely upwardly. The fur brush 58*b* and the cleaning blade 58*a* are respectively disposed in an upper portion and a lower portion of the opening 64. A collecting roller 66 having a polygonal cross-section is accommodated in an upper portion of the toner tank 62 slightly below the fur brush 58*b*. Located in such a position, the collecting roller 66 is journalled to the toner tank 62 by shafts 68 which individually protrude from opposite ends of the roller 66. The collecting roller 66 is driven in a rotary motion in a direction indicated by an arrow by a driving system, not shown. A collecting blade 70 is implemented by a polyester film or similar flexible material and is mounted on the inner surface of an upper portion of the toner tank 62 by a bracket 73 in such a manner as to extend obliquely downward. The tip of the blade 70 is held in contact with the collecting roller 66. A horizontal partition 72 is situated below the collecting roller 66 to define a space 74 in cooperation with the bottom 62*a* of the toner tank 62. The space 74 is large enough to accommodate toner particles therein.

Figure 4:
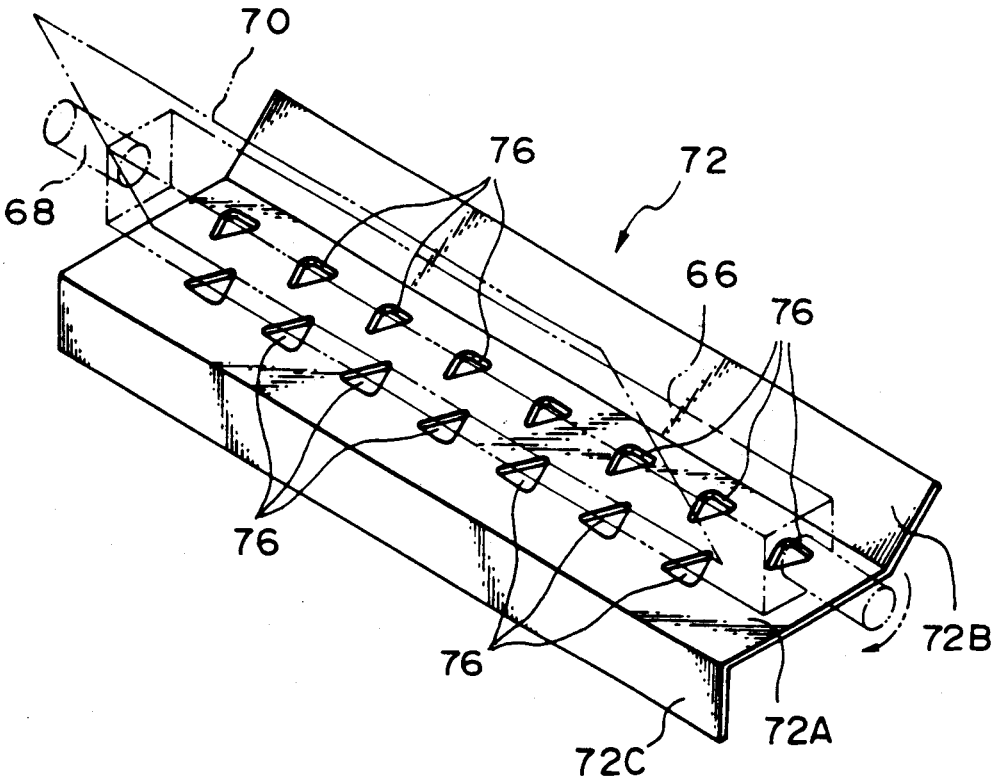
FIG. 4 is a perspective view of a partition shown in FIG. 3.

As shown in FIG. 4, the partition 72 is made up of a horizontal intermediate portion 72A, a toner receiving portion 72B extending obliquely upward from the rear edge of the intermediate portion 72A, and a toner guide portion 72C extending downward from the front edge of the intermediate portion 72A. A number of substantially triangular holes 76 are formed through the intermediate portion 72A while being spaced apart from each other in the axial direction of the collecting roller 66. More specifically, two arrays of holes 76 are formed through the intermediate portion 72A and in a stagerred configuration in the axial direction of the collecting roller 66.

A sensor 78 is mounted on the top of the toner tank 62. The sensor 78 is made up of a diaphragm 78*a*, a feeler 78*b*, and a photointerrupter 78*c*.

Figure 5A:
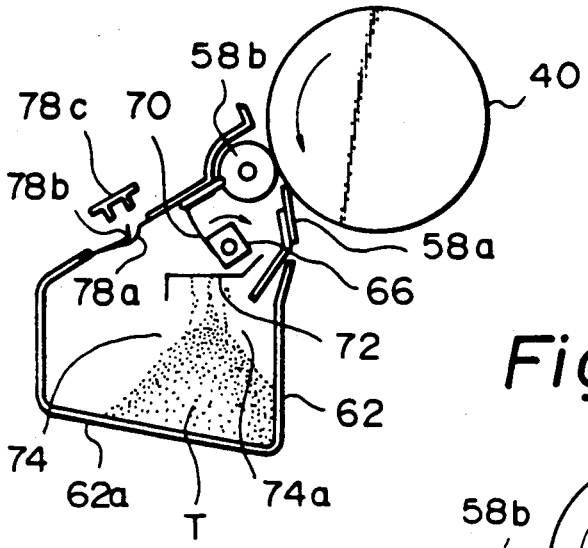
FIGS. 5A to 5C are sectional views demonstrating the operation of the toner collecting device of FIG. 3.
Figure 5B:
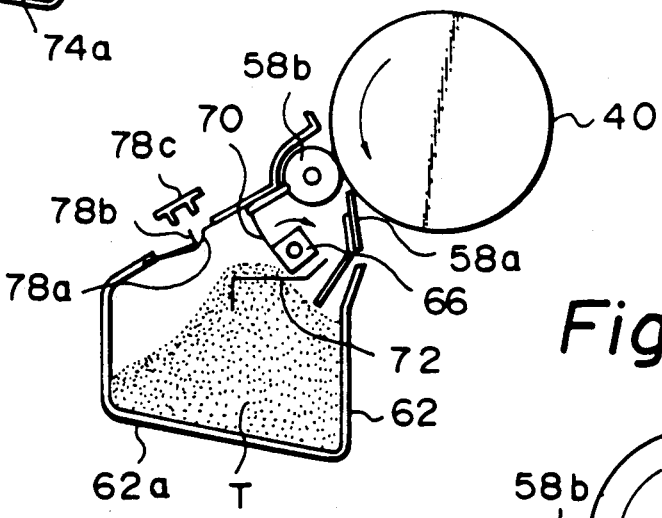
Figure 5C:
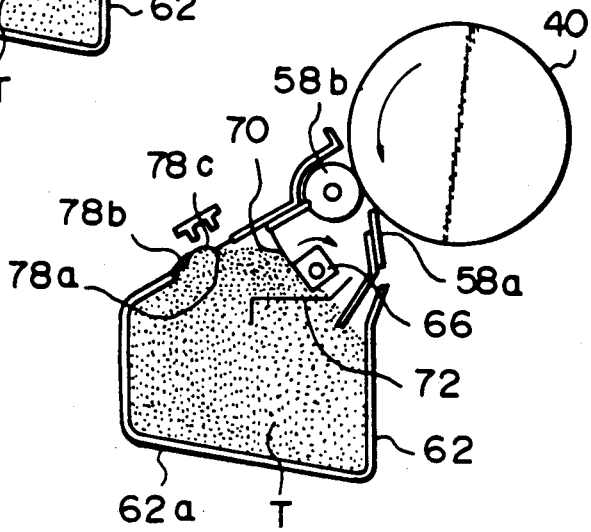

In the above construction, toner particles removed from the drum 40 by the cleaning blade 58*a* and fur brush 58*b* are dropped onto the partition 72 and then driven from the toner receiving portion 72B to the intermediate portion 72A by the collecting roller 66. The toner particles reached the intermediate portion 72A are dropped through the holes 76 onto the bottom 62*a* of the toner tank 62. Therefore, in a first stage, the toner T sequentially accumulates in the space 74*a* between the partition 72 and the bottom 62*a* of the toner tank 62, as shown in FIG. 5A. In a second stage which is shown in FIG. 5B, the toner T fills up the space 74*a* and then accumulates on the partition 72. In this stage, the toner T is repetitively forced out along the partition 72 by the oscillatory motion of the collecting blade 70 and is thereby dropped along the guide portion of the partition 72. Consequently, the toner T accumulates in the remaining space of the toner tank 62 below the level where the partition 72 is located. In a third stage, as shown in FIG. 5C, the toner T accumulate to a level above the partition 72. Then, while the weight of that part of the toner T which is positioned above the partition 72 acts on the collecting blade 70, the blade 70 further forces out the toner T by overcoming the weight. As the toner T fills up the whole toner tank 62, it forces the diaphragm 78*a* and thereby the feeler 78*b* upward to block the optical path of the photointerrupter 78*c*. The resulting output of the photointerrupter 78*c* indicates that the toner tank 62 is full.

Figure 6A:
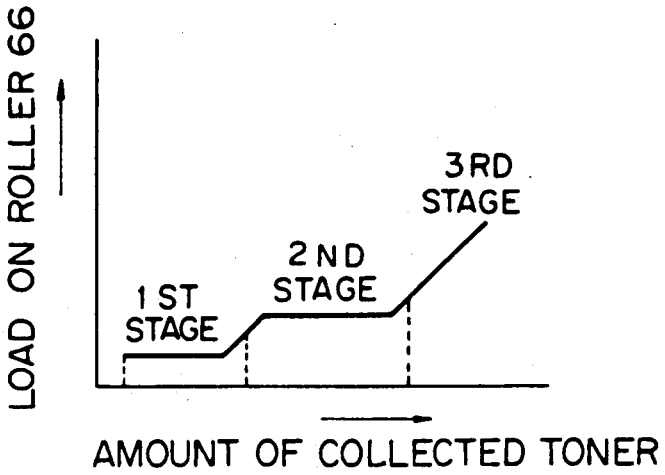
FIGS. 6A and 6B are graphs showing respectively a variation in the load acting on a collecting roller particular to the prior art and a variation in the same attainable with the present invention, with respect to the increase in the amount of toner being collected.
Figure 6B:
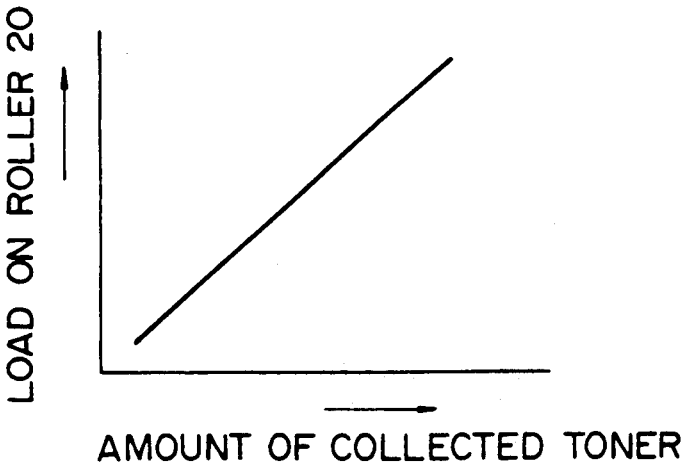
Fig. 6B PRIOR ART

FIGS. 6A and 6B are graphs useful for understanding an advantage of the present invention over the prior art. Specifically, as shown in FIG. 6A, the load acting on the collecting roller 66 of the illustrative embodiment is extremely small in the above-stated first and second stages and sharply increases in the third stage. Nevertheless, only that part of the toner T disposed above the partition 72 constitutes the load. In contrast, as shown in FIG. 6B, the load particular to the prior art shown in FIG. 1 sequentially increases from the initial stage and, moreover, substantially the entire amount of collected toner constitutes the load.

In summary, it will be seen that the present invention provides a toner collecting device which reduces the load acting on a collecting roller due to a collected toner and thereby allows a minimum of fluctuation to occur in the rotation of a driving system. This insures clear-cut images which are free from jitters. Further, since the load acting on a collecting blade is reduced also, the blade can force out the toner in a smooth oscillatory motion so that efficient use of a toner tank is promoted.

Various modifications will become possible for those skilled in the art after receiving the teachings of the present disclosure without departing from the scope thereof.

What is claimed is:

1. A device for use in an electrophotographic apparatus for collecting a toner which remains on a photoconductive element after imagewise transfer, comprising:

a toner tank having an opening formed in an upper portion thereof for collecting the toner which is removed from the photoconductive element;

toner feeding means located below and in close proximity to the opening of said toner tank for feeding into said toner tank the removed toner which is introduced in said opening; and partitioning means disposed below and in close proximity to said toner feeding means;

said toner tank having a bottom which cooperates with said partitioning means to define a space for accommodating a major part of the collected toner;

said toner feeding means comprising a collecting roller having a polygonal cross-section and rotatable in a predetermined direction, and a collecting blade held in contact with said collecting roller and movable in an oscillatory motion in response to the rotation of said collecting roller;

said partitioning means comprising a partition having a plurality of holes through which the collected toner may drop.

2. A device as claimed in claim 1, wherein said holes of the partition of the partitioning means are formed in two rows and in a staggered configuration in the axial direction of the collecting roller.

3. A device as claimed in claim 1, wherein each of said holes of the partition of the partitioning means are triangular.

4. A device as claimed in claim 1, wherein said partition comprises a toner receiving portion for receiving the toner from the opening, an intermediate portion through which the holes are formed, and a guide portion for guiding the toner forced out by said collecting blade toward the space of said toner tank.

5. A device as claimed in claim 1, further comprising a sensor for sensing that said toner tank has been filled up with the collected toner.

6. A device as claimed in claim 1, further comprising removing means held in contact with the photoconductive element for removing the toner from said photoconductive element.

7. A device as claimed in claim 6, wherein said removing means comprises a cleaning blade and a fur brush.

* * * * *